United States Patent [19]

Böttcher et al.

[11] Patent Number: 4,566,681

[45] Date of Patent: Jan. 28, 1986

[54] COLLATING MACHINE WITH ERROR-INDICATING REJECTION DEVICE

[75] Inventors: Rolf Böttcher, Markkleeberg; Hans-Jürgen Lindner, Lützschena, both of German Democratic Rep.

[73] Assignee: VEB Kombinat Polygraph "Werner Lamberz" Leipzig, Leipzig, German Democratic Rep.

[21] Appl. No.: 412,320

[22] Filed: Aug. 27, 1982

[30] Foreign Application Priority Data

Oct. 26, 1981 [DD] German Democratic Rep. ... 234352

[51] Int. Cl.[4] ..... B65H 39/02; B65H 39/055

[52] U.S. Cl. ..... 270/58; 270/5 A

[58] Field of Search ..... 412/11, 12; 270/58, 270/54

[56] References Cited

U.S. PATENT DOCUMENTS

| | | | |
|---|---|---|---|
| 3,519,264 | 7/1970 | Beacham et al. | 270/58 |
| 3,525,516 | 8/1970 | Bushnell et al. | 270/58 |
| 3,652,078 | 3/1972 | Sather et al. | 270/58 |
| 3,972,521 | 8/1976 | Reed | 270/58 |

FOREIGN PATENT DOCUMENTS 0042187 5/1968 Fed. Rep. of Germany .

2030942 12/1972 Fed. Rep. of Germany .

*Primary Examiner*—Paul A. Bell
*Assistant Examiner*—Taylor J. Ross
*Attorney, Agent, or Firm*—Jordan and Hamburg

[57] ABSTRACT

The invention relates to a collating machine with several successively arranged feeders for the conveyance of sheets of paper on a conveyor line and with control devices at each feed station to monitor the formation of book blocks from which machine cycle-dependent error signals are output in the event of missed or duplicate feeding. It is the object of the invention to alter the operational flow of a conveyor line in such a way that in the event of defective book blocks, a manual separation of the book blocks and sorting of the individual sheets or sheet layers into the magazines at the feed stations can be eliminated. According to the invention, this is achieved by using a micro-computer to control a sliding rejection device with a station number indicator, located at the end of the conveyor line for the book blocks. The defective, separated book blocks are completed or corrected by an operator and sorted into the sliding device for inclusion into the remaining operational flow of the conveyor line, taking into consideration the associated station number appearing on the station number indicator.

6 Claims, 1 Drawing Figure

COLLATING MACHINE WITH ERROR-INDICATING REJECTION DEVICE

BACKGROUND OF THE INVENTION AND PRIOR ART STATEMENT

The invention relates to a collating machine with several successively arranged feeders for the conveyance of sheets of paper on a conveyor line and a control device at every feed station to monitor the book block formation, from which machine cycle-dependent error signals are released in the case of a missed or duplicate feed.

Conveyor lines have been previously known in the preparation of book blocks, which, in the event of an error in the feeding process, for instance, the occurence of a missed or duplicate sheet, sort out the defective book blocks by means of a sheet control- and switch device, from the sheet advance flow at the appropriate time at a station located at the end of a feed line, according to WP 42 187. The book blocks, which have been sorted out, have to be taken apart manually by an operator, i.e., the sheets of paper have to be distributed onto the individual feed stations. In a different binding system for signatures with a conveyor, in accordance with DE-AS No 20 30 942, this substantial manual effort is reduced in that, following the occurrence of a disturbance at a deposition station, all successive feeders deposit no further signatures onto the already defective book block. If the defective book block is generated at one of the first feed stations, the effort required to manually separate the book blocks and sort the individual sheets or sheet layers into the magazines at the feed stations is minimal. However, in the case of almost completed book blocks, this effort is no longer justifiable.

It is the object of the invention to alter the operational flow of a conveyor line in such a way that, in the case of defective book blocks, the manual separation of the book blocks and the sorting of the individual sheets or sheet layers into the magazines at the feed stations can be eliminated.

SUMMARY OF THE INVENTION

It is the object of the invention, in the case of an error in the feeding process, i.e., in the case of a missing sheet, duplicate sheet or part of a sheet missing, to provide successful completion of the book block in the case of missing sheets, or correction in the case of duplicate sheets, by means of a suitable device. According to the invention, this object is accomplished by a micro-computer (micro-processor), used to control a sliding device at the end of the conveyor line for the book blocks, and in which the machine cycle-dependent length of a test signal and error signals delivered by the control devices at the feed stations are furnished as input values. Following a period of time, calculated by the micro-computer in accordance with the program and dependent on the machine cycle and impulses which are delivered from the sensing elements of the control devices to the individual feed stations, the micro-computer sends an output signal to activate the sliding device, as well as a station number indicator.

The defective book block is fed into the magazine of the sliding device, above which a station number indicator is located, on which the number of the station causing the error can be read for the book block located in the respective compartment of the magazine. If an additional defective book block is sorted out, the previous book block is forwarded into the next compartment of the magazine of the sliding device, together with its station number, so that the station causing the error, and the kind of error, can be read for several book blocks successively.

If the book block contains two or more defects, no station number is shown. In this special case, the book block has to be separated manually. All separated book blocks are made complete or corrected by an operator, taking into account the type of error shown by the indicator, for instance, missed or duplicate feeding, and sorted into the sliding device for insertion in the remaining operational flow of the conveyor line.

The micro-computer can also have an alpha-numeric input port, in which by means of a data entry keyboard for instance, the station numbers can be entered, enabling the calling in of additional output data, for instance of error rates.

Making a comparison with an allowable error rate set by the program, the micro-computer, when exceeding the same, outputs a signal for activating the failure report indicator. In the case of a symmetrical error, i.e., successively appearing errors at one feed station, output port 14 outputs a signal for the shut down of the machine.

Figure 1:
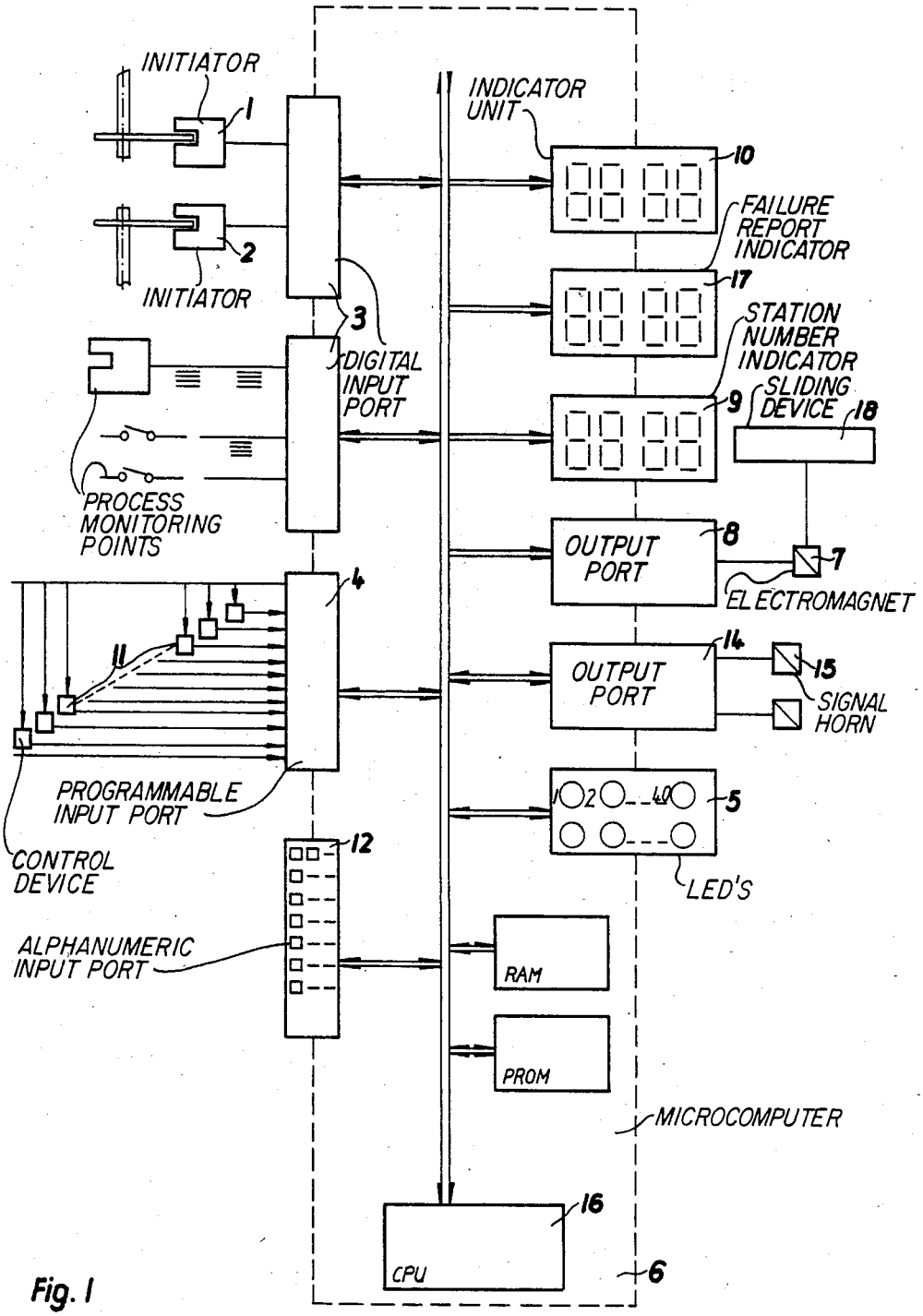
FIG. 1 is a schematic illustration of the present invention

The drawing shows an exemplified embodiment of the invention. On the timing shaft of the binding machine two initiators 1, 2 are arranged, connected to the digital input port 3 of micro-computer 6 via pulse conducting cable. In an additional programmable input port 4, the pulse conducting cables of control device 11 are connected to all feed stations. Furthermore, an alphanumeric input port 12, with a keyboard for the input of the station numbers, is provided. Output port 8 serves to control the sliding device 18 for the book blocks by means of an electromagnet 7. Above the magazine of the sliding device 18, station number indicator 9 is located. An additional output port 14 is connected to signal horn 15 and to a service and failure report indicator 17. An overview of the current error rate is provided by an error indicator, running at the system clock, which can thus pinpoint the site of the defective book block by means of LED's 5. Indicator units 10 and 17 receive additional output data such as, for instance, for display of the error rate and characteristic error results as well as the type of error.

To fully utilize the capacity of the computer, additional process monitoring points 13 can be provided.

A sheet of paper is deposited at each feed station onto the book block, which is moved forward stepwise by the conveyor, per operating cycle of the binding machine.

However, control device 11 signals an error only in a determined phase of the operating cycle, i.e., as long as the contact is maintained between the sensing device and a suitable testing portion of the sheet of paper on the feeder drum according to function, a signal is emitted in the event of failure. At the same time, a test signal must be released by micro-computer 6, which, during this time, is applied to input port 4. The beginning of this test signal is determined by the provided initiator 1, located on the timing shaft of the binding machine in a defined position. The duration of the test signal is determined by a definite number of pulses from initiator 2, which at the same time inputs the machine pulses to the microcomputer. An error signal, delivered from the control device at a feed station, is applied to the programmable input port 4 during this limited time interval controlled by initiators 1 and 2, and depending on the pending test signal, forwarded as information to microcomputer 6. From here, the information is processed as a signal, in conjunction with the number of pulses from the binding machine, for the control of the sliding device 18, and output port 8 is made ready. From this, the sliding device is activated by means of electromagnet 7 to remove defective book blocks from the conveyor flow and at the same time insert a non-defective book block. Upon the registration of a missing or duplicate sheet of paper through input port 4, the number of the station causing the error is recorded in the memory of the micro-computer, and shown on station number indicator 9 at the time of separation. Sliding device 18 has a magazine for the storage of several successively separated book blocks and the station number indicator has a corresponding number of indicator fields. The indication of the station causing the error for the corresponding book block is delivered to the next indicator field in synchronization with its advancing in the magazine.

The registered error signals are called in by input ports 3 and 4, and stored, evaluated and processed into output signals for the service and failure report indicator and/or for activating a signal horn and/or for shut down of the operation of the binding machine in output port 14 of micro-computer 6, in a memory area belonging to the respective monitoring points, and according to the program.

Over the input keyboard of alpha-numeric input module 12, it is possible to call in the error rate for the individual numbers of the feed stations and other monitoring points, and to read them on indicator unit 10.

We claim:

1. In a binding apparatus for the formation of book blocks of the type wherein individual sheets are fed to be formed into book blocks, and including a plurality of control devices for monitoring the formation of book blocks by signalling the faulty deposition of more than one sheet at a time and/or a missing sheet, the improvement comprising a programmable microcomputer having a digital input port, said microcomputer being connected to receive signals from said control devices at said input port, and a sliding device comprising a station number indicator, said sliding device being adjustable in response to signals from said microcomputer to successively receive a plurality of defectively formed book blocks each containing more than one of the same sheet or missing a sheet, said station number indicator having a plurality of fields for separately indicating the control device of the faulty formation each defective book block whereby the defect of each defective book block is readily determined.

2. The apparatus of claim 1 additionally comprising a timing shaft, and an initiator on said timing shaft for determining the starting time of a test signal from the microcomputer, said initiator releasing output pulses which are received and digitally entered by the digital input port of said microcomputer.

3. The apparatus of claim 2 additionally comprising a second initiator for determining the duration of test signals and the apparatus cycle on the timing shaft of the apparatus, said second initiator releasing output pulses which are received and digitally entered by the digital input port of said micro-computer.

4. The apparatus of claim 1, in which the microcomputer additionally comprises an indicator unit, and at least one alpha-numeric input port which in turn comprises a keyboard, said indicator unit being connected to display additional processing information requested by operating the keyboard on the alpha-numeric input port.

5. The apparatus of claim 4, in which the microcomputer additionally comprises an additional indicator unit, and an output port connected to said additional indicator unit, said additional indicator unit being connected to display a localized failure report for all control devices.

6. The apparatus of claim 5, in which said output port is connected to output an output signal for sounding an alarm and/or shutting down operation of the apparatus when a predetermined permissible failure rate at a certain monitoring position is exceeded.

* * * * *